US009440476B2

(12) United States Patent
Danzinger et al.

(10) Patent No.: US 9,440,476 B2
(45) Date of Patent: Sep. 13, 2016

(54) THERMAL IMAGABLE WATERLESS LITHOGRAPHIC MEMBER

(75) Inventors: Oded Danzinger, Ramat-Gan (IL); Avigdor Bieber, Ra'ananna (IL); Michael Karp, Tikva (IL); Sergei Bonder, Haifa (IL)

(73) Assignee: VIM Technologies Ltd., Kibbutz Hanita (IL)

( * ) Notice: Subject to any disclaimer, the term of this patent is extended or adjusted under 35 U.S.C. 154(b) by 1080 days.

(21) Appl. No.: 13/225,473

(22) Filed: Sep. 4, 2011

(65) Prior Publication Data

US 2012/0055363 A1 Mar. 8, 2012

Related U.S. Application Data

(60) Provisional application No. 61/380,616, filed on Sep. 7, 2010.

(51) Int. Cl.
*B41N 1/00* (2006.01)
*B41C 1/10* (2006.01)

(52) U.S. Cl.
CPC ..... *B41N 1/003* (2013.01); *B41C 1/1033* (2013.01)

(58) Field of Classification Search
None
See application file for complete search history.

(56) References Cited

U.S. PATENT DOCUMENTS

| | | | | |
|---|---|---|---|---|
| 5,339,737 | A | 8/1994 | Lewis et al. | |
| 5,353,705 | A | 10/1994 | Lewis et al. | |
| 5,378,580 | A | 1/1995 | Leenders | |
| 6,071,369 | A * | 6/2000 | Vermeersch et al. | 156/272.8 |
| 6,346,253 | B2 * | 2/2002 | Takaoka et al. | 424/400 |
| 2003/0233953 | A1 * | 12/2003 | Pan et al. | 101/217 |
| 2009/0025591 | A1 * | 1/2009 | Teng | B41C 1/1008 101/450.1 |

FOREIGN PATENT DOCUMENTS

| | | |
|---|---|---|
| GB | 1489308 | 10/1977 |

* cited by examiner

*Primary Examiner* — Joshua D Zimmerman
(74) *Attorney, Agent, or Firm* — Morgan, Lewis & Bockius LLP

(57) ABSTRACT

A layered printing plate that attains a high degree of clarity and improved clean out. The printing plate may include an oleophilic substrate, a laser absorbing imaging layer and an oleophobic silicon layer. One embodiment utilizes an amine resin rather than a traditional polymer as the basic organic matter of the imaging layer, adds of colloidal silica into the imaging layer to improve the cleanout properties, and utilizes a substrate that absorbs IR radiation rather than reflects it.

7 Claims, 4 Drawing Sheets

THERMAL IMAGABLE WATERLESS LITHOGRAPHIC MEMBER

CROSS-REFERENCE TO RELATED APPLICATIONS

This is a utility patent application being filed in the United States Patent Office as a non-provisional application for patent under Title 35 U.S.C. §100 et seq. and 37 C.F.R. §1.53(b) and, claiming the benefit of the prior filing date under Title 35, U.S.C. §119(e) of the provisional application for patent that was filed in the United States Patent Office on 7 Sep. 2010 and assigned Ser. No. 61/380,616, which application is incorporated herein by reference in its entirety.

BACKGROUND

The present disclosure is related to the field of lithographic printing, and more particularly, to the manufacturing of a lithographic printing member that is used in waterless offset printing systems.

In offset lithography printing, an image is presented on a lithographic printing member, such as a printing plate or a printing cylinder, wherein the imaged area has a pattern of ink-accepting (oleophilic and/or hydrophobic) and ink-repellent (oleophobic and/or hydrophilic) surface areas. There are two general offset printing methods, a wet method and a dry method (waterless). The wet method, which is the traditional method, uses a fluid that is dampened (or "fountain") to the printing member prior to the ink. The fluid, such as water, covers the ink-repellent surface areas and repels the ink that is applied later to the printing plate, but does not affect the oleophilic character of the image areas. Therefore, traditionally, the non-image areas are called hydrophilic areas while the ink-accepting areas are called hydrophobic areas.

The typical dry or waterless lithographic printing member has at least two layers with at least two layers having a different affinity for printing ink. For instance, one layer is made of or includes an oleophobic material that rejects ink, such as silicone rubber. Another layer is made of or includes an oleophilic material such as polyester. Therefore, in dry printing systems, the plate is simply inked and the ink is carried by the oleophilic areas that were exposed imagewise.

It should be noted that the terms "printing member", "printing plate", "lithographic printing member" and "plate" are used interchangeably herein. It also should be noted that the terms "ink-accepting" and "oleophilic" are used interchangeably herein and it should be noted that the terms "ink-repellent" and "oleophobic" are used interchangeably herein.

In waterless printing methods, the image is patterned over the plate creating ink-accepting (oleophilic) and ink-rejecting (oleophobic) surface areas. Ink that is applied to the lithographic printing member is carried by the oleophilic areas and is transferred to a recording medium in the image-wise pattern. Typically, the inked printing member first makes contact with an intermediate surface called a blanket cylinder, which, in turn, applies the image ink to the paper or other recording medium.

There are several ways to expose the image over a printing member. Some of those methods involve direct computer to plate (CTP) equipment. Common imaging methods of a printing member exposes the printing member image-wise by a computer control laser radiation, usually using infrared (IR) or near IR radiation. The image-wise IR radiation elevates the temperature of the IR absorber and deanchoring the top oleophobic layer.

For example, Great Britain patent 1489308 (Eames) describes a dry planographic printing plate comprising an ink receptive substrate, an overlying silicone rubber layer, and an interposed layer comprised of laser energy absorbing particles (such as carbon particles) in a self-oxidizing binder (such as nitrocellulose). The described planographic plates are exposed to focused near IR radiation with a YAG laser. The absorbing layer converts the infrared energy to heat thus partially loosening, vaporizing or ablating the absorber layer and the overlying portions of the silicone rubber layer. Similar plates are described in Research Disclosure 19201, 1980 as having vacuum-evaporated metal layers to absorb laser radiation in order to facilitate the removal of a silicone rubber overcoated layer. These plates are described as being developed by wetting with hexane and rubbing. Other publications describing ablatable printing plates include U.S. Pat. No. 5,339,737 (Lewis et al.), U.S. Pat. No. 5,353,705 (Lewis et al.), U.S. Pat. No. 5,378,580 (Leenders).

Many of the currently available ablatable printing plates designed to absorb laser energy include an IR absorbing substance, such as a pigment and/or dye, and self-oxidizing polymer binders such as nitrocellulose and a crosslinking agent like melamine.

All ablative plates, after imaging, undergoing a cleaning process to remove residue of the ablated silicone from the plate. The cleaning process can include the application of solvents and can be a wet or dry process. Solvent cleaning processes are not user friendly or ecologically friendly. Water based or dry cleaning of the plate is a more suitable ecological means of cleaning the plate, but it requires effort and time to release all residue of silicone from the image, especially in the case of high resolution imaging such as 300 lpi or more.

A few examples of existing printing members and methods for manufacturing them are now presented as further background of the related technology. One example of prior art IR ablative waterless printing plates utilize a silicone top layer, a second layer or imaging layer including IR sensitive laser absorbing material and a substrate. The top layer is silicone, like polydimethylsiloxane rubber, with a thickness of about 2 microns. The second layer is made of a polymer and/or a cross-linkable resin, IR absorbing pigment or dye, and a cross-linking agent. In many existing plates, the polymer or resin layer can be made up of nitrocellulose, which operates as the ablating agent layer as it is self-oxidized by thermal irradiation. Other polymers are also described for such applications, such as derivatives of vinyl terpolymer, polyvinylidenchloride, cyanoacrylate polymer binder etc. Usually, the thickness of such layers is in the range of 0.5-1 microns. In other prior art printing member, the second layer can be constructed of metal, metal oxide or a combination thereof, usually applied in vacuum.

Typically, the substrates described in the prior art is made from aluminum or polyester film and is either clear or white. In case of aluminum substrates, an insulating layer is applied between the substrate and the imaging IR sensitive layer. This insulating layer serves to prevent the imaging layer from dissipating the thermal energy provided by the laser to the metal or substrate. This insulating layer typically has oleophilic ink receptive properties.

BRIEF SUMMARY

In the high-end offset printing field, there is need for printing high-quality images with resolution higher than 300 lpi. In high resolution printing, the sharpness of the dot edges is very important to achieve high-quality images, and the clean out of the printing member after exposure is equally important. However, achieving sharp dot edges and high-degrees of cleanout in existing waterless lithographic plates that are thermally ablated can be significantly difficult. The creation of sharp dot edges and the complete removal of silicone residues from small dense dot areas is a difficult task in preparing common waterless thermal ablative printing members.

Embodiments of lithographic printing members disclosed throughout the present disclosure solve the above-described needs in the art. One or more of the disclosed embodiments provide a lithographic printing member, having a layer structure, with improved imaging and ablating debris cleaning abilities. It will be appreciated that the disclosed embodiments, and features and/or aspects thereof present novel printing members that allow for obtaining high quality images with fine and precision dots in printing resolution of 350 lpi or more.

In some embodiments, an exemplary IR ablation layer, which comprises IR absorbing dye and amine resin as the basic organic matter of the ablation layer, can provide fine and accurate imaging and easy cleaning of debris after the imaging. In some embodiments, the amine resin can be in the amount of approximately 15% or more of the composition of the imaging layer, by weight. A preferable range of the amount, by weight, of the amine resin can be approximately 30-70% of the composition of the imaging layer. The utilization of amine resin as the basic organic matter is not a common practice in the printing plate art. The reason for this is that in common printing plates the amine resin, similar to melamine based oligomers, are used as a cross-linker and not as the basic organic material. In an exemplary novel printing plate, the amine resin replaces the traditional polymer that is used as a basic organic matter of the imaging layer.

In addition, adding colloidal silica to the composition of the imaging layer improves the cleanout properties, thereby allowing the printing of clean and accurate images at resolution 350 lpi or higher.

Furthermore, using a substrate that absorbs IR radiation, such as a black substrate in contrast to existing printing plates having reflective substrates, an unexpected high quality of exposed dot is obtained. Black or non-reflective substrate operates to prevent dot extension or image distortion near the edges of the imaging area and delivers sharp dots.

Advantageously, the novel and unobvious approach of the present disclosure delivers a sharper image and enables an increased printing resolution.

The foregoing summary is not intended to summarize each potential embodiment or every aspect of each embodiment, and other features and advantages of the present disclosure will become apparent upon reading the following detailed description of the embodiments with the accompanying drawings and appended claims.

Furthermore, although specific exemplary embodiments are described in detail to illustrate the inventive concepts to a person skilled in the art, such embodiments can be modified to various modifications and alternative forms. Accordingly, the figures and written description are not intended to limit the scope of the inventive concepts in any manner.

DETAILED DESCRIPTION OF VARIOUS EMBODIMENTS

The present disclosure presents various embodiments, as well as features and aspects that can be incorporated into one or more embodiments, of techniques for fabricating and structures of a layered printing plate that attains a high degree of clarity and improved clean out. The various embodiments of the layered printing plate utilize an amine resin rather than a traditional polymer as the basic organic matter of the imaging layer, the addition of colloidal silica into the imaging layer to improve the cleanout properties, and utilizing a substrate that absorbs IR radiation rather than reflects it.

Turning now to the figures in which like numerals represent like elements throughout the several views, exemplary embodiments of the layered printing plate are described. The purpose of the drawings is to describe exemplary embodiments and not for production. Therefore, dimensions of components and features shown in the figures are chosen for convenience and clarity of presentation and are not necessarily shown to scale.

Figure 1:
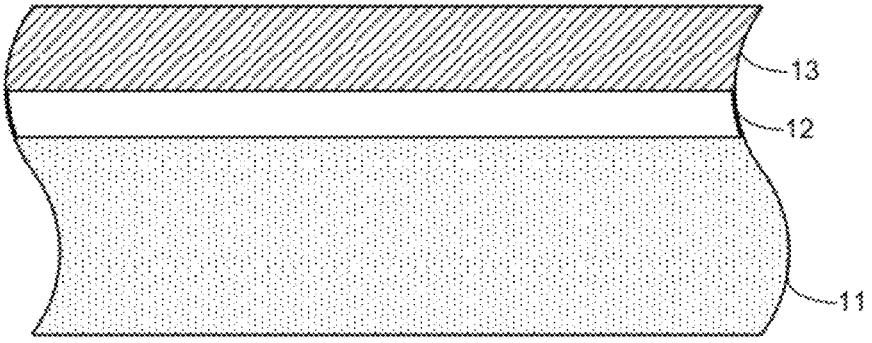
FIG. 1 is cross-sectional view of an exemplary three-layer structure of printing plate utilizing black PET or other non-metal substrate that absorbs IR radiation.

FIG. 1 is cross-sectional view of an exemplary three-layer structure of a printing plate utilizing black PET or other non-metal substrate that absorbs IR radiation. The illustrated embodiment is shown as including an oleophilic substrate layer 11, a laser absorbing imaging layer 12, and an oleophobic layer 13. The laser absorbing imaging layer 12 can be made of a composition including an infrared absorptive substance, such as a pigment and/or dye and is positioned above the substrate layer 11. It should be appreciated that the term "positioned above" can indicated that the layer is formed on the surface of the underlying layer or, the layer may have one or more additional layers between it and the underlying layer to which it is above. The oleophobic layer 13 is positioned above the imaging layer 12.

Figure 2:
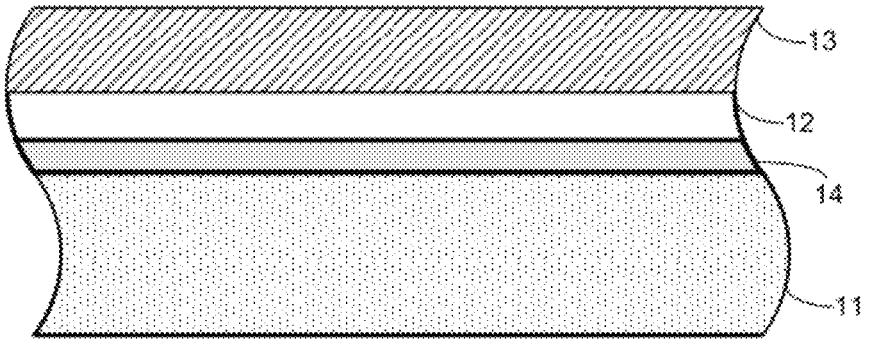
FIG. 2 is cross-sectional view of an exemplary four-layer structure of plate with aluminum substrate or other metal substrate.

FIG. 2 is cross-sectional view of an exemplary four-layer structure of plate with aluminum substrate or other metal substrate. The embodiment illustrated in FIG. 2 illustrates an alternative embodiment that may have a primer or insulation layer 14 in between the imaging layer 12 and the oleophobic layer 13. The primer layer may be added for improving adhesion of the imaging layer 12 to the substrate 11. The insulating layer 14 is beneficial when the substrate 11 is aluminum or other metal.

Among other things, layer 14 functions to prevent the metal from dissipating the thermal energy provided by the laser. Layer 14 has oleophilic, or ink receptive properties.

Many types of polymeric coatings or inorganic coatings can be used for preparing this layer. Illustrative examples of ink receptive resins for layer 14 comprise phenol-, cresol- and melamine-formaldehyde resins, vinyl resins, polyester resins, acrylate resins, polyvinyl chloride, polyvinyl acetate, polystyrene, etc.

The substrate 11 serves two major functions. First of all, the substrate 11 may provide the mechanical support for the printing member. Furthermore, the substrate 11 may have a different affinity characteristics for ink than the top layer 13.

An exemplary printing member may have a substrate 11 made of polymer, such as but not limited to polyester. The substrate 11 has an oleophilic surface. The surface of the oleophilic substrate 11 is exposed by imaging radiation that imagewise ablates layer 12 and 13. In some exemplary embodiments, the thickness of the substrate 11 may be in the range of 0.003 to 0.02 inches (about 0.08 mm to 0.5 mm). A wide variety of materials may be used for fabricating the substrate 11 such as, but not limited to, polymers, paper, metal etc. In particular, the substrate may be made of polyvinylchlorides (PVC) polyesters, polycarbonates, polyolefins, etc. Such substrates may be made of polyethylene terephthalate film, such as but not limited to the polyester films available under the trademarks of MYLAR and MELINEX polyester films from DuPont Teijin Films, polyester films of SKC. At the end of the fabrication of the printing member, the substrate 11 may be laminated over a metal substrate, such as but not limited to aluminum. The lamination may be done for improving the mechanical features of the printing member.

Black polyester, when is used as the material for substrate 11, improves plate performance by providing sharper images with well defined elements and dots and allows printing at high imaging resolutions—350 lpi and higher. Such polyester contains carbon black which is an IR absorptive pigment. Further, black polyester may have insignificant reflectivity from the substrate surface. The measured reflected portion of incident IR radiation from the exemplary blacked substrate is typically below approximately 10%. In most of the substrate, the reflected energy was about 7%-8% of the incident energy. Because such polyester film at the above-mentioned thickness has practically zero transparency, it absorbs more than approximately 92% of the IR radiation that is passed through the imaging layer. The black and non-reflective substrate prevents any reflection back to the imaging layer of IR radiation. Advantageously, using a black substrate reduces the dots gain or image distortion near the edges. Reducing the dot extension improves the sharpness of the image and enables printing in a higher resolution. This is accomplished because the printed dots with reduced dot extension can fit the size of a dot in high resolution. Suitable types of black polyester films for the substrate 11 are SB00 of SKC, Seocho-gu Seoul, South Korea, Lumirror X30 of Toray Plastics, North Kingstown, LTI GB of Lee Tat Industrial, Kowloon, Hong Kong.

Other exemplary embodiment may use other substrates with low reflectivity. As an alternative embodiment, an additional non-ablative coating layer with low reflectivity can be applied on the substrate 11.

Exemplary imaging layer 12 can comprise IR absorptive pigments like carbon black and/or other IR absorptive dyes like phthalocyanine, merocyanine, polymethine, indoaniline, oxonol, pyrilium, squarilium, dithiolene dyes or thin metal, metal oxide or metal/metal oxide layer, like titanium, titanium oxide, aluminum/aluminum oxide.

Another exemplary embodiment of the plate member includes a laser absorbing imaging layer 12 that further includes a dispersion of inorganic nano-particles. A few non-limiting examples of such inorganic nano-particles include colloidal silica and colloidal alumina. The placement of the colloidal or nano-particles in imaging layer improves post-imaging cleaning and allows for the complete removal of silicone residues even from very dense screen with resolutions of 350 lpi and higher. In various embodiments, the concentration of colloidal or nano-particles in the imaging layer may be in the range, of 5 to 60% in solid by weight.

In some exemplary embodiments of the printing members, the imaging layer or the IR absorbing layer, may comprise self-condensation oligomeric amine resin as the basic organic matter of the imaging layer. In some embodiments, the amine resin can be in the amount, by weight, of 15% or more of the composition of the imaging layer. A preferable range of the amount of the amine resin can be from approximately 30-70% of the composition of the imaging layer. Employing amine resin as the basic organic matter is unusual in the printing plate art because in common printing plates, amine resin like melamine based oligomers are used as crosslinker and not as the basic organic material. In the exemplary embodiments, the amine resin replaces the traditional polymer that is used as a basic organic matter of the imaging layer. Using the amine resin as the basic organic matter improves the sharpness of the image and allows for a higher resolution in the image. A non-limiting example of an oligomeric amines includes methylated melamines, known under trade mark Cymel from Cytex. Amine resins like methylated and alkylated melamines usually are used as crosslinking additives for hydroxyl and carboxyl containing polymers.

The amine resin is used as the main binder and film-forming material of the imaging layer and provides non-predicted improvements in imaging results. Different types of amine resins may be used such as, methylated melamines, alkilated melamines, imino mixed ether melamines, buthylated melamines, urea oligomers and other.

Figure 3:
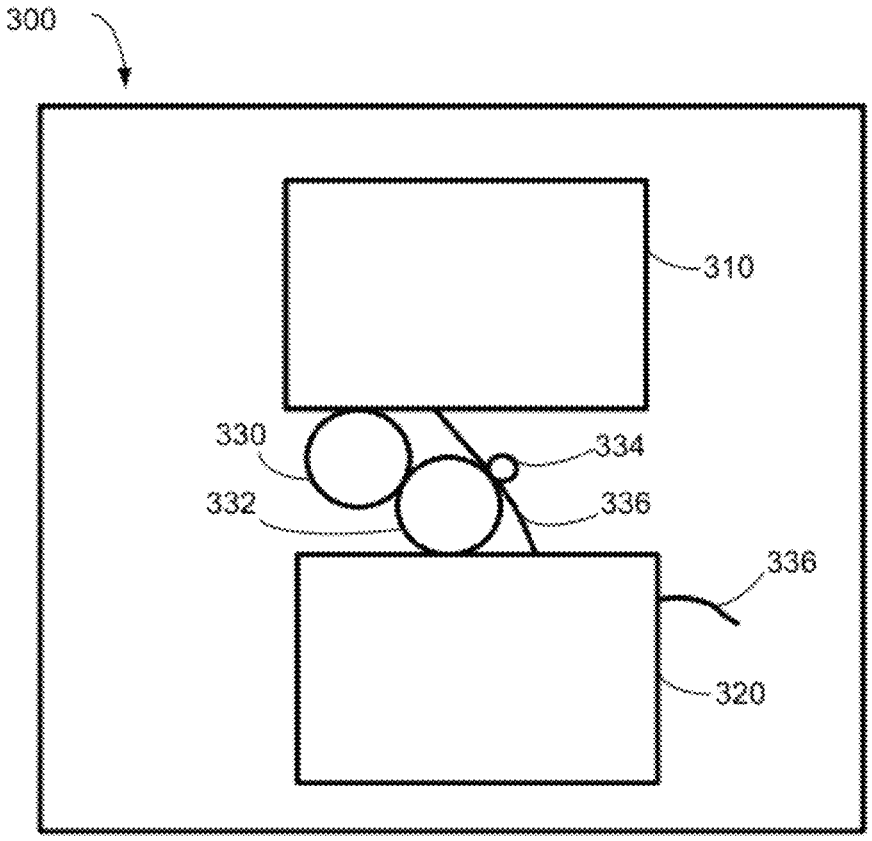
FIG. 3 is a block diagram of a waterless lithographic printing system incorporating an embodiment of the multi-layer printing plate.

FIG. 3 is a block diagram of a waterless lithographic printing system incorporating an embodiment of the multi-layer printing plate. The illustrated printing system 300 includes an image processing system 310 and a media finishing section 320. The details of various printing systems can vary greatly and so, the particular are not provided as they are well known to those skilled in the relevant art. However, as can be seen from the illustrated environment, a multi-layered printing plate 330 is incorporated into the system for receiving ink from the image processing system 310 and depositing the ink onto roller 332, which in turn, in cooperation with pressure roller 334, transfers the image to media 336. The media 336 is then fed through the media finishing section 320. Thus, it can be appreciated that the various embodiments of the printing plate can be embodied in a variety of printing systems.

Figure 4:
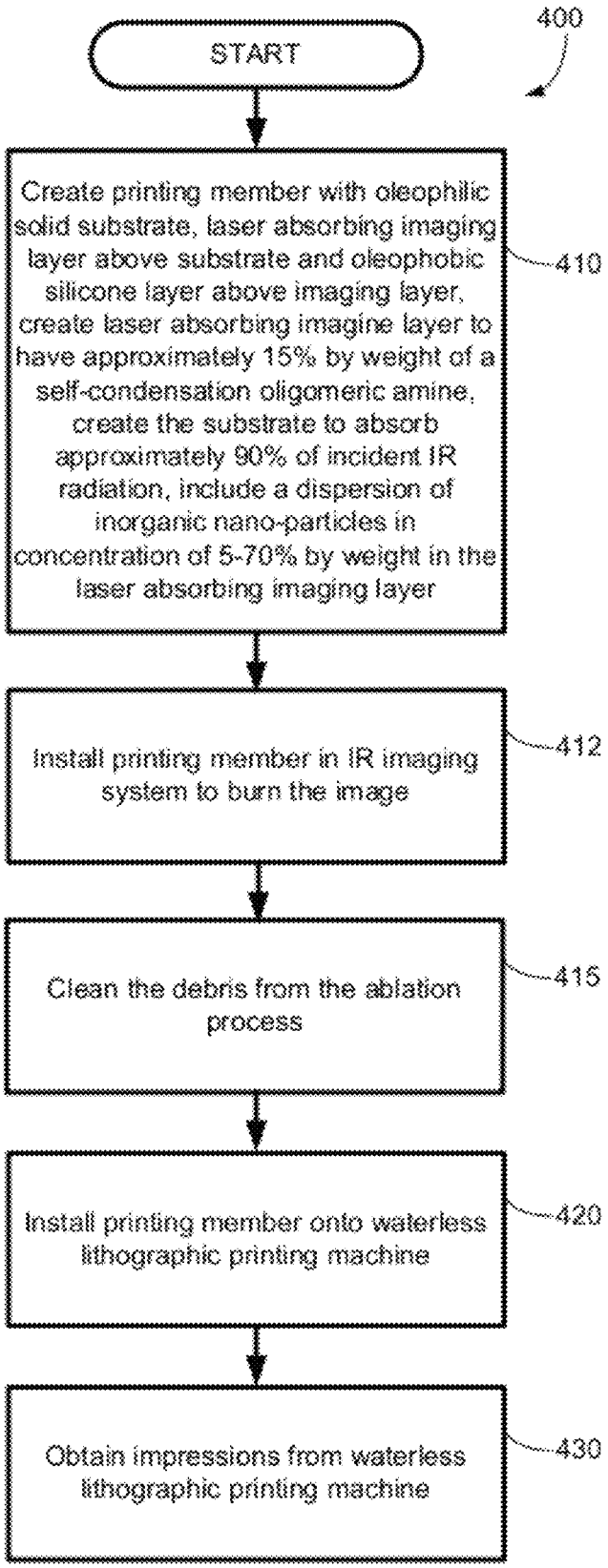
FIG. 4 is a flowchart with relevant actions of a waterless lithographic printing method incorporating an embodiment of the multi-layer printing plate.

FIG. 4 is a flow diagram illustrating an exemplary process for utilizing various embodiments of the layered printing member. Initially the process of creating prints using a waterless lithographic printing machine 400 begins by creating the printing member 410 as described in more detail in conjunction with FIGS. 1 and 2. The printing member is created such that it includes an oleophilic solid substrate; a laser absorbing imaging layer and an oleophobic silicone layer. The laser absorbing imaging layer is positioned above the substrate and comprises an infrared absorbing substance of approximately 15-70% by weight of a self-condensation oligomeric amine. The oleophobic silicone layer is positioned above the laser absorbing imaging layer. Next the printing member is installed in IR imaging system to burn the image 412. Next procedure is cleaning of debris 415. Next, the printing member is installed onto a waterless lithographic printing machine 420. Finally, the waterless lithographic printing machine is operated to generate impressions 430. In some embodiments, the solid substrate is created such that it absorbs approximately 90% of the infrared radiation that is incident on the surface of the solid substrate. In other embodiments, the action of creating the printer member further comprises creating a printer member in which the laser absorbing imaging layer comprises an oligomeric amine concentration that is approximately between 30 to 70% by weight. In yet other embodiments, the action of creating a printer member further comprises creating a printer member in which the laser absorbing imaging layer further comprises a dispersion of inorganic nanoparticles in a concentration of 5-60% by weight.

Figure 5:
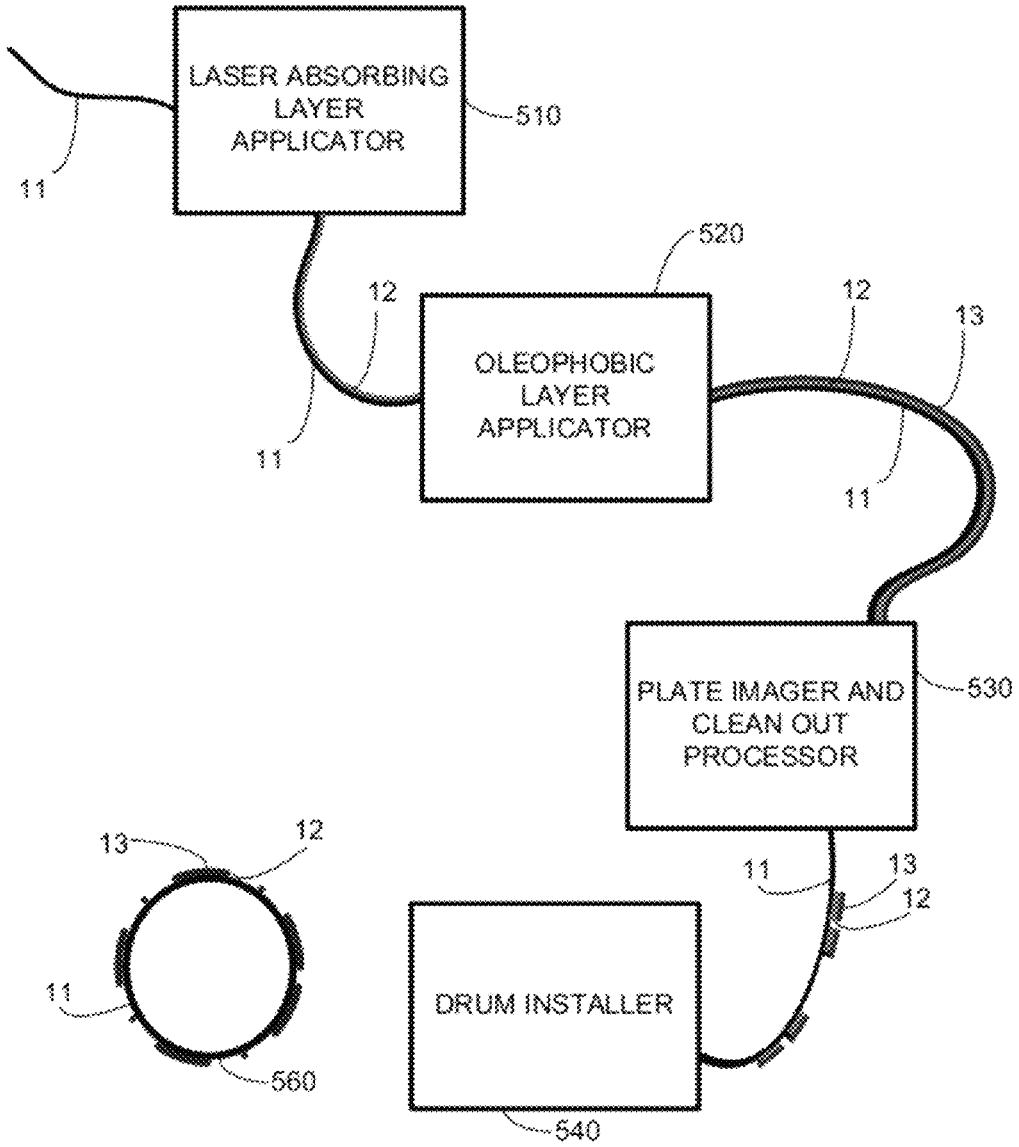
FIG. 5 is a process flow diagram showing the steps involved in creating various embodiments of the printing member.

FIG. 5 is a process flow diagram showing the steps involved in creating various embodiments of the printing member. Initially, a substrate 11 is fed into the laser absorbing imaging layer applicator 510. As a result, the laser absorbing imaging layer 12 is thus positioned above the substrate 11. As previously mentioned, the laser absorbing imaging layer 12 may be directly on top of the substrate 11 or may be separated by one or more additional layers, such as an insulating layer, an IR trapping layer, an IR filtering layer etc. The material is then fed through the oleophobic layer applicator 520 which operates to place an oleophobic layer 13, such as silicone, positioned above the laser absorbing imagine layer 12. At this point the printing member is ready for imaging and as such, is fed to the plate imager and clean out processor 530 where the plate is exposed to an image via IR radiation and then the ablated areas are removed by the clean out procedure leaving an image on the printing member in which the substrate 11 is exposed for receiving ink, and non-ablated oleophobic areas 13 remain for repelling ink—thus creating an image. Finally, in a particular embodiment, the plate is then fed through a drum installer 540 where the imaged plate is placed on a drum and ready to be installed in a printing system.

It should be understood that the various stages or processes illustrated in FIG. 5 can be performed by a machine, a micro-controller, an electro-mechanical system, a computer system, manual controls, or any variety or combination of these and other techniques. As such, a process block may include a processor, memory, control signals to operate mechanical devices, sensors for detecting operations by mechanical devices, etc.

Following are few examples of suitable compositions for the laser absorbing layer of an exemplary printing plate and techniques of constructing and utilizing the plates.

EXAMPLE 1

In example 1, a laser absorbing imaging layer (which would correspond to element 12 in FIGS. 1 and 2) of the following composition was applied to a substrate (which would correspond to element 11 in FIGS. 1 and 2) comprised of clear 175 micron polyester film SH-92 of SKC Co. Ltd, Seocho-gu Seoul, South Korea:

| Ingredients of laser absorbing layer | Weight, % |
|---|---|
| Infra red dye, sold under trade name IR-9807 by Adam Gates & Company LLC , Flemington, NJ, USA | 1.6 |

-continued

| Ingredients of laser absorbing layer | Weight, % |
|---|---|
| Methylated Imino Melamine crosslinking agent, sold under the trade name of Cymel 327 by Cytec Industries Inc, West Paterson, NJ, USA | 3.2 |
| Phosphoric acid 85% | 0.1 |
| Methyl ethyl Ketone | 47.6 |
| Isopropyl Alcohol | 47.6 |

The coating composition was applied to the substrate using a No 5 mayer rod and dried for 2 minutes at 140° C. The weight of the dry coating was 0.4 g/m$^2$. Further for example 1, on top of the laser absorbing imaging layer, the following silicone layer composition was applied:

| Ingredients of silicone layer | Weight % |
|---|---|
| Vinyl terminated polydemethyl siloxane' VM & P Naphtha solution, sold under the trade name SS4331 by GE BAYER SILICONES. GMBH & CO. KG, Bergen op Zoom, Netherlands | 50 |
| Platinum catalyst sold by the trade name SS8010 by GE BAYER SILICONES. GMBH & CO. KG, Bergen op Zoom, Netherlands | 0.7 |
| Reactive polysiloxane copolymer crosslinker agent sold under the trade name SL6020 by GE BAYER SILICONES. GMBH & CO. KG, Bergen op Zoom, Netherlands. | 0.7 |
| Heptane | 48.6 |

The silicone coating was applied using a No 8 mayer rod and dried for a period of 2 minutes at 140° C. The weight of the dry coating was 2 g/m2.

The plate was imaged by Kodak Quantum Trendsetter 800 thermal CTP system, laser wave length 830 nm. Silicone debris was cleaned by wiping with soapy water.

The plate was installed on a GTO-46 printing press, and during a printing run, good quality impressions were obtained.

EXAMPLE 2

In example 2, a laser absorbing imaging layer of the following composition was applied to a clear 175 micron polyester film SH-92 of SKC Co. Ltd, Seocho-gu Seoul, South Korea:

| Ingredients of laser absorbing layer | Weight % |
|---|---|
| Methylethyl ketone dispersion of colloidal silica, sold under the trade name of MEK-ST by Nissan Chemical America Corporation, Houston, TX, USA | 1.6 |
| Infra red Dye, sold under trade name IR-9807 by Adam Gates & Company LLC, Flemington, NJ, USA | 1.6 |
| Methylated Imino Melamine crosslinking agent, sold under the trade name of Cymel 327 by Cytec Industries Inc, West Paterson, NJ, USA | 3.1 |
| Phosphoric acid 85% | 0.1 |
| Methyl ethyl Ketone | 46.8 |
| Isopropyl Alcohol | 46.8 |

The coating composition was applied to the substrate using a No 5 mayer rod and dried for 2 minutes at 140° C. The weight of dry coating was 0.5 g/m2.

Further, for example 2, on top of this laser absorbing layer the above-described silicone layer composition for example 1 was applied.

The plate was imaged by a Kodak Quantum Trendsetter 800 thermal CTP system, laser wave length 830 nm. Silicone debris was cleaned by wiping with soapy water.

The plate was installed on GTO-46 printing press, and during a printing run, good quality impressions were obtained.

EXAMPLE 3

In example 3, the following composition for a thermal insulating layer was applied to a 150 micron aluminum sheet 1050 H18 of Alcoa European Mill Products, Geneve Switzerland:

| Ingredients of isolation formula | Weight % |
|---|---|
| UCAR ™ VMCH Vinyl Resin, Texas, USA | 10 |
| Methylethyl Ketone | 70 |
| Isopropyl Alcohol | 20 |

The thermal insulating layer was applied to the substrate using a No 8 mayer rod and dried for a period of 2 minutes at 120° C. The weight of dry coating was 3 g/m2.

On top of the insulating layer, the laser absorbing imaging layer and the silicone layer as described in Example 2 was applied.

The plate was then imaged by Kodak Quantum Trendsetter 800 thermal CTP system, laser wave length 830 nm. The silicone debris was cleaned by wiping with soapy water.

The plate was installed on GTO-46 printing press, and during a printing run, good quality impressions were obtained.

EXAMPLE 4

In example 4, the laser absorbing imaging layer and the silicone layer as described in example 2 were applied to a black 188 micron polyester film SB00 of SKC Co. Ltd, Seocho-gu Seoul, South Korea.

Reflectivity of the polyester film SB00 at wave length 830, as measured on a Cary UV-VIS-IR Photospectrometer, Model 500 was between 7 and 7.5%. Taking this measurement into account along with the characteristic that this substrate has zero transmission, then it is clear that the substrate absorbs 93-93.5% of incident radiation.

The plate in this example 4 was then imaged by a Kodak Quantum Trendsetter 800 thermal CTP system, laser wave length 830 nm. The silicone debris was cleaned by wiping with soapy water.

The plate was installed on GTO-46 printing press and after a printing run, good quality 350 lpi resolution impressions were obtained.

EXAMPLE 5

In example 5, a 0.15 micron thick aluminum/aluminumoxide MMO layer was applied by vacuum vapor deposition to a black 188 μ polyester SB00 of SKC film. The aluminum/aluminumoxide MMO layer was applied by Hanita Coatings Ltd., Hanita, Israel using the same processemployed when it manufactures the B05012P, B03612P products. The silicone layer as described in example 1 was then applied onto the aluminum/aluminum oxide layer.

The plate of example 5 was then imaged using a Kodak Quantum Trendsetter 800 thermal CTP system, laser wave length 830 nm. The silicone debris was cleaned by wiping with soapy water.

The plate was then installed onto a GTO-46 printing press and after a printing run, good quality resolution impressions were obtained.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A waterless lithographic printing member, comprising:

a. an oleophilic solid substrate;

b. a laser-absorbing imaging layer positioned above the substrate, wherein the imaging layer comprises an infrared-absorbing substance; and c. a silicone layer positioned above the imaging layer, the silicone layer being oleophobic, wherein the laser-absorbing layer contains a binder consisting essentially of CYMEL 327.

2. The printing member of claim 1, wherein the laser-absorbing layer contains between approximately 30 to 70% by weight of CYMEL 327.

3. The printing member of claim 1, wherein the laser-absorbing layer comprises a dispersion of inorganic nano-particles.

4. The printing member of claim 3, wherein the nano-particles comprise colloidal silica.

5. The printing member of claim 3, wherein the nano-particles comprise colloidal alumina.

6. The printing member of claim 3, wherein the dispersion of inorganic nano-particles is in a concentration of 5-60% by weight.

7. The printing member of claim 1, further comprising an oleophilic insulation layer positioned between the substrate and the imaging layer.

* * * * *